US010607766B2

(12) United States Patent
Shiokawa

(10) Patent No.: US 10,607,766 B2
(45) Date of Patent: Mar. 31, 2020

(54) COIL COMPONENT INCLUDING COIL DISPOSED ON A PROJECTION

(71) Applicant: Murata Manufacturing Co., Ltd., Kyoto (JP)

(72) Inventor: Noboru Shiokawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 492 days.

(21) Appl. No.: 14/996,561

(22) Filed: Jan. 15, 2016

(65) Prior Publication Data

US 2016/0217918 A1 Jul. 28, 2016

(30) Foreign Application Priority Data

Jan. 22, 2015 (JP) ..... 2015-010585
Apr. 23, 2015 (JP) ..... 2015-088726

(51) Int. Cl.
*H01F 27/29* (2006.01)
*H01F 17/04* (2006.01)
(Continued)

(52) U.S. Cl.
CPC ..... *H01F 27/29* (2013.01); *H01F 27/006* (2013.01); *H01F 27/2823* (2013.01); *H01F 27/2828* (2013.01)

(58) Field of Classification Search
CPC ..... H01F 27/29; H01F 17/045; H01F 27/006
See application file for complete search history.

(56) References Cited

U.S. PATENT DOCUMENTS 5,262,745 A * 11/1993 Gutierrez ..... H01F 27/292 336/192
5,787,571 A * 8/1998 Hatakenaka ..... H01F 27/027 29/605
(Continued)

FOREIGN PATENT DOCUMENTS

CN 102257582 A 11/2011
CN 103165258 A 6/2013
(Continued)

OTHER PUBLICATIONS

JPH03192708A, Machine Translation, Aug. 1991.*
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a winding core portion; a first flange portion and a second flange portion disposed on both ends of the winding core portion; electrodes disposed on the first flange portion and the second flange portion; a first coil portion and a second coil portion electrically connected between the electrode of the first flange portion and the electrode of the second flange portion and connected to each other in series; and a projection portion disposed on an end surface of the first flange portion on the side opposite to the winding core portion. The first coil portion is disposed on the winding core portion, the second coil portion is disposed on the projection portion, and the first coil portion has an inductance value different from an inductance value of the second coil portion.

9 Claims, 13 Drawing Sheets

(51) Int. Cl.
*H01F 27/00* (2006.01)
*H01F 27/28* (2006.01)

(56) References Cited

U.S. PATENT DOCUMENTS

| | | | | | |
|---|---|---|---|---|---|
| 6,027,008 | A * | 2/2000 | Toi | H01F 27/292 | 228/110.1 |
| 6,339,364 | B1 * | 1/2002 | Reddy | H03H 7/06 | 336/212 |
| 7,113,067 | B2 * | 9/2006 | Hirai | H01F 17/045 | 336/192 |
| 7,382,221 | B2 * | 6/2008 | Morimoto | H01F 17/045 | 336/180 |
| 9,659,701 | B2 * | 5/2017 | Tomonari | H01F 17/045 | |
| 2005/0212644 | A1 * | 9/2005 | Yoshimori | H01F 5/02 | 336/224 |
| 2007/0063803 | A1 * | 3/2007 | Yamashita | H01F 17/045 | 336/83 |
| 2010/0188180 | A1 * | 7/2010 | Morimoto | H01F 17/045 | 335/302 |
| 2011/0248810 | A1 * | 10/2011 | Ukawa | H01F 5/04 | 336/192 |
| 2013/0154784 | A1 * | 6/2013 | Hachiya | H01F 17/045 | 336/200 |

FOREIGN PATENT DOCUMENTS

| | | | | | |
|---|---|---|---|---|---|
| JP | 02241010 | A | * | 9/1990 | |
| JP | H02-241010 | A | | 9/1990 | |
| JP | H03192708 | A | * | 8/1991 | H01F 41/06 |
| JP | 05-62022 | A | | 3/1993 | |
| JP | H07-272937 | A | | 10/1995 | |
| JP | 2004-006696 | A | | 1/2004 | |
| JP | 2004-356473 | A | | 12/2004 | |
| JP | 2009-094389 | A | | 4/2009 | |

OTHER PUBLICATIONS

An Office Action; "Notification of Reasons for Refusal" issued by the Japanese Patent Office dated Oct. 17, 2017, which corresponds to Japanese Patent Application No. 2015-088726 and is related to U.S. Appl. No. 14/996,561; with English translation.

Notification of the First Office Action issued by the State Intellectual Property Office of the People's Republic of China dated Dec. 26, 2017, which corresponds to Chinese Patent Application No. 201510968885.9 and is related to U.S. Appl. No. 14/996,561.

* cited by examiner

COIL COMPONENT INCLUDING COIL DISPOSED ON A PROJECTION

CROSS REFERENCE TO RELATED APPLICATIONS

This application claims benefit of priority to Japanese Patent Application No. 2015-010585 filed Jan. 22, 2015, and to Japanese Patent Application No. 2015-088726 filed Apr. 23, 2015, the entire content of which is incorporated herein by reference.

TECHNICAL FIELD

The present disclosure relates to a coil component.

BACKGROUND

Conventional coil components include a coil component described in Japanese Utility Model Publication No. H5-62022. The coil component has a winding core portion, flange portions disposed on both ends of the winding core portion, electrodes disposed on the flange portions, and a coil portion wound around the winding core portion.

SUMMARY

Problem to be Solved by the Disclosure

The conventional coil component shunt-connected and mounted on a signal line of a substrate has a problem of occurrence of resonance in a high-frequency band due to the coil portion wound around the winding core portion. As a result, a signal of the signal line propagates in a shunt direction and deteriorates the propagation characteristics of the signal line, resulting in a problem of deterioration in signal quality.

Therefore, a problem of the present disclosure is to provide a coil component capable of suppressing the deterioration in the propagation characteristics of the signal line.

Solutions to the Problems

To solve the problem, the present disclosure provides a coil component comprising:

a winding core portion;

a first flange portion and a second flange portion disposed on both ends of the winding core portion;

electrodes disposed on the first flange portion and the second flange portion;

a first coil portion and a second coil portion electrically connected between the electrode of the first flange portion and the electrode of the second flange portion and connected to each other in series; and a projection portion disposed on an end surface of the first flange portion on the side opposite to the winding core portion, wherein the first coil portion is disposed on the winding core portion, the second coil portion is disposed on the projection portion, and the first coil portion has an inductance value different from an inductance value of the second coil portion.

According to the coil component of the present disclosure, the first coil portion is disposed on the winding core portion while the second coil portion is disposed on the projection portion, and the inductance value of the first coil portion is different from the inductance value of the second coil portion. Therefore, since the second coil portion is added to the first coil portion, when the coil component is shunt-connected and mounted on a signal line of a substrate, an impedance is made higher by generating a plurality of resonances in other than the resonance frequency range generated by the first coil portion acting as a main coil, and a wider bandwidth can consequently be achieved in frequency characteristics so as to suppress a mode associated with a signal propagating in the shunt direction. Thus, the deterioration in the propagation characteristics of the signal line can be suppressed to prevent the deterioration in signal quality.

Preferably, in the coil component of an embodiment, the second coil portion has an axis coaxial with an axis of the first coil portion.

The axis of the first coil portion refers to a central axis of a coil shape when the first coil portion is in the coil shape. The same applies to the second coil portion. The second coil portion having an axis coaxial with an axis of the first coil portion means that the axis of the second coil portion is coincident (concentric) on the extended line thereof with the axis of the first coil portion.

According to the coil component of the embodiment, since the axis of the second coil portion is coaxial with the axis of the first coil portion, the first coil portion and the second coil portion can concentrically be wound. This stabilizes the winding of the first and second coil portions and stabilizes the winding pitches of the first and second coil portions, thereby suppressing variations in the frequency characteristics.

Preferably, in the coil component of an embodiment, the second coil portion has an axis different from an axis of the first coil portion.

The second coil portion having an axis different from an axis of the first coil portion means that the axis of the second coil portion is not coincident (not concentric) on the extended line thereof with the axis of the first coil portion. For example, the axis of the second coil portion may be parallel on the extended line thereof to the axis of the first coil portion, or the axis of the second coil portion may not intersect on the extended line thereof with the axis of the first coil portion, or the axis of the second coil portion may intersect on the extended line thereof with the axis of the first coil portion at one point.

According to the coil component of the embodiment, since the axis of the second coil portion is not coaxial with the axis of the first coil portion and is a different axis, the second coil portion can be made closer to a peripheral edge of an end surface of the first flange portion. As a result, a connection line connecting the first coil portion and the second coil portion can be reduced in length. Therefore, the resonance due to reflection of a signal wave attributable to the length of the connection line can be suppressed.

Preferably, in the coil component of an embodiment, the axis of the second coil portion is eccentric from the axis of the first coil portion toward the electrode of the first flange portion.

According to the coil component of the embodiment, since the axis of the second coil portion is eccentric from the axis of the first coil portion toward the electrode of the first flange portion, the second coil portion can be made closer to the electrode. As a result, a connection line connecting the second coil portion and the electrode can be reduced in length. Therefore, the resonance due to reflection of a signal wave attributable to the length of the connection line can be suppressed.

Preferably, in the coil component of an embodiment, the winding core portion has a plurality of surfaces arranged in a circumferential direction around an axis extending in both end directions of the winding core portion, and at least one surface of the plurality of surfaces is inclined relative to the axis of the winding core portion.

According to the coil component of the embodiment, since at least one surface of the plurality of surfaces of the winding core portion is inclined relative to the axis of the winding core portion, an area of a cross section orthogonal to the axis of the winding core portion can be varied along the axis of the winding core portion, and a wider bandwidth can be achieved in the frequency characteristics of the first coil portion disposed on the winding core portion. Therefore, the mode associated with a signal propagating in the shunt direction can be suppressed.

Preferably, in the coil component of an embodiment, the first flange portion has a cutout allowing passage of a connection line connecting the first coil portion and the second coil portion.

According to the coil component of the embodiment, since the first flange portion has the cutout allowing passage of the connection line connecting the first coil portion and the second coil portion, a wiring route of the connection line can be made shorter. Therefore, the resonance due to reflection of a signal wave attributable to the length of the connection line can be suppressed.

Preferably, in the coil component of an embodiment, the electrodes are disposed on a bottom surface of the first flange portion and a bottom surface of the second flange portion, and the winding core portion has a bottom surface disposed with a groove portion close to at least one of the first flange portion and the second flange portion.

According to the coil component of the embodiment, when the coil component is manufactured, for example, the bottom surface of the first flange portion and the bottom surface of the second flange portion are immersed in a liquid electrode material to form the electrodes. In this case, since the winding core portion has the bottom surface disposed with the groove portion close to at least one of the first flange portion and the second flange portion, the liquid electrode material does not contact the bottom surface of the winding core portion because of the groove portion. Therefore, the liquid electrode material can be restrained from moving upward and wetting the bottom surface of the winding core portion, so as to prevent the formation of the electrode on the bottom surface of the winding core portion. Thus, electric connection can be prevented between the first coil portion disposed on the winding core portion and the electrode.

Preferably, in the coil component of an embodiment, the bottom surface of the winding core portion is inclined from one end to the other end of the winding core portion to come closer to the axis extending in both end directions of the winding core portion, and the groove portion is disposed on the one end side of the winding core portion.

According to the coil component of the embodiment, the groove portion is disposed, between the both ends of the winding core portion, on the one end side of the winding core portion having a smaller distance in the height direction from the bottom surface of the first flange portion and the bottom surface of the second flange portion. Since the groove portion can be disposed on a part of the winding core portion with which the liquid electrode material easily comes into contact at the time of formation of the electrode, the formation of the electrode on the bottom surface of the winding core portion can further reliably be prevented.

Preferably, in the coil component of an embodiment, a protrusion is disposed on an end surface of the second flange portion on the side of the winding core portion.

According to the coil component of the embodiment, the protrusion is disposed on the end surface of the second flange portion on the side of the winding core portion. As a result, when the first coil portion is wound from the second flange portion to the first flange portion, the start position of winding of the first coil portion around the winding core portion can be positioned by the protrusion to stabilize the shape of winding of the first coil portion around the winding core portion.

Effect of the Disclosure

The coil component of the present disclosure has the first coil portion disposed on the winding core portion, the second coil portion disposed on the projection portion, and the inductance value of the first coil portion different from the inductance value of the second coil portion, and therefore can suppress the deterioration in the propagation characteristics of the signal line.

DETAILED DESCRIPTION

The present disclosure will now be described in detail with reference to shown embodiments.

First Embodiment

Figure 1:
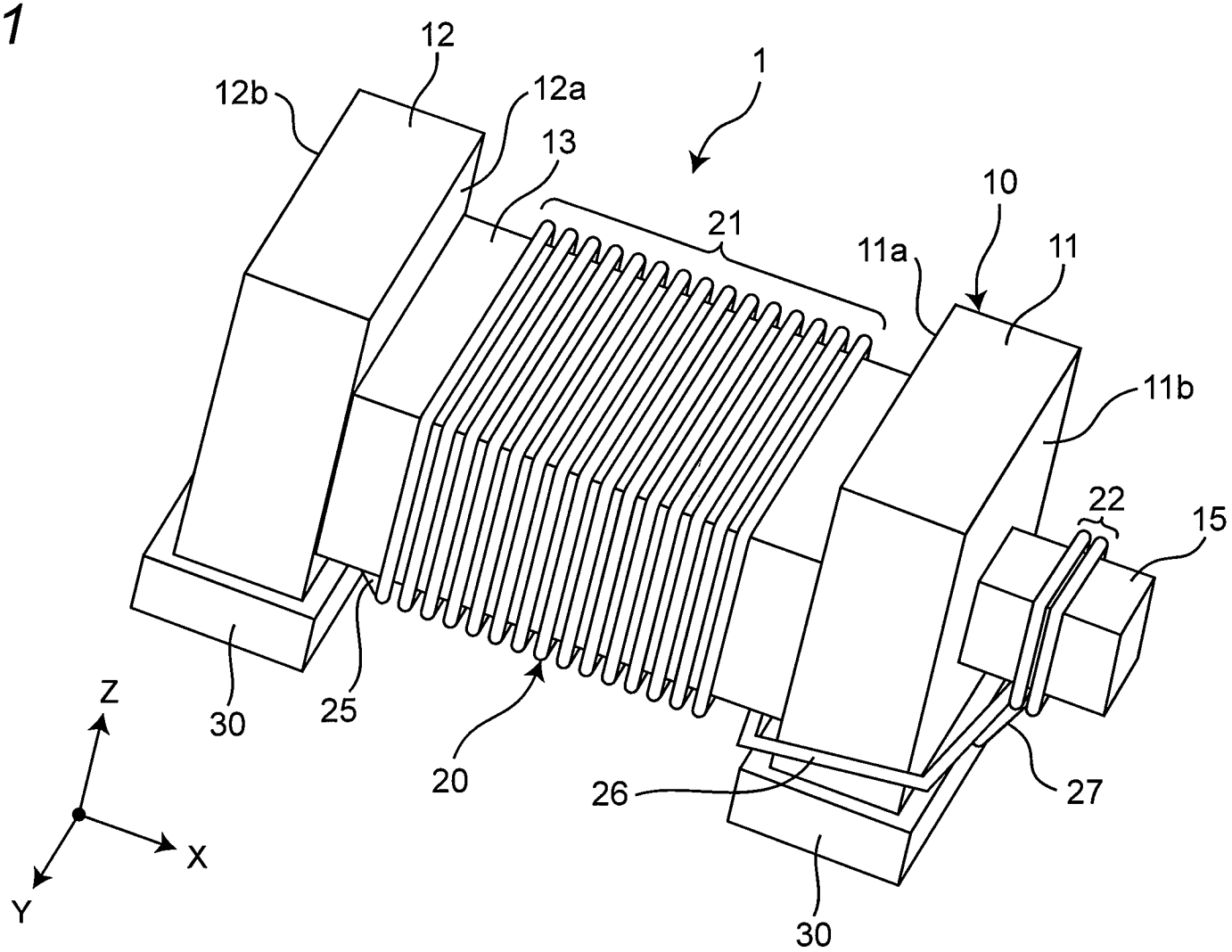
FIG. 1 is a perspective view of a coil component of a first embodiment of the present disclosure.

FIG. 1 is a perspective view of a coil component of a first embodiment of the present disclosure. As shown in FIG. 1, a coil component 1 has a core 10, a coil conductor 20 disposed on the core 10, and electrodes 30 disposed on the core 10.

The core 10 has a winding core portion 13, a first flange portion 11 disposed at one end of the winding core portion 13, a second flange portion 12 disposed at the other end of the winding core portion 13, and a projection portion 15 disposed on the first flange portion 11. The core 10 is made of a material having a dielectric constant of 20 or less, for example, alumina (non-magnetic material), Ni—Zn-based ferrite (magnetic material, insulating material), and resin. The core 10 is integrally formed by press molding of the material with a die, for example.

A bottom surface of the core 10 is defined as a surface mounted on a substrate, and a top surface of the core 10 is defined as a surface on the side opposite to the bottom surface of the core 10. A direction connecting one end and the other end of the winding core portion 13 is defined as an X-direction, a direction orthogonal to the X-direction on the bottom surface of the core 10 is defined as a Y-direction, and a direction connecting the bottom surface and the top surface of the core 10 is defined as a Z-direction. The Z-direction is orthogonal to the X-direction and the Y-direction. The X-direction is defined as the length direction of the coil component 1, the Y-direction is defined as the width direction of the coil component 1, and the Z-direction is defined as the height direction of the coil component 1.

The winding core portion 13 extends from one end toward the other end thereof. An axis of the winding core portion 13 extends in both end directions of the winding core portion 13 in parallel with the X-direction. A cross-sectional shape of the winding core portion 13 on a Y-Z plane is rectangular. The cross-sectional shape of the winding core portion 13 on the Y-Z plane may be other shapes such as a circle.

The first flange portion 11 has a first end surface 11*a* on the side of the winding core portion 13 and a second end surface 11*b* on the side opposite to the winding core portion 13. Similarly, the second flange portion 12 has a first end surface 12*a* and a second end surface 12*b*. The first end surface 11*a* of the first flange portion 11 is connected to the one end of the winding core portion 13, and the first end surface 12*a* of the second flange portion 12 is connected to the other end of the winding core portion 13. The shape of the first and second flange portions 11, 12 is a rectangular parallelepiped. The shape of the first and second flange portions 11, 12 may be other shapes such as a circular column.

The projection portion 15 is disposed on the second end surface 11*b* of the first flange portion 11. The shape of the projection portion 15 is a rectangular parallelepiped. An axis of the projection portion 15 is coaxial with the axis of the winding core portion 13. An area of a cross section orthogonal to the axis of the projection portion 15 is smaller than an area of a cross section orthogonal to the axis of the winding core portion 13. The shape of the projection portion 15 may be other shapes such as a circular column.

The electrodes 30 are disposed on the bottom surface side of the first flange portion 11 and the bottom surface side of the second flange portion 12. The electrodes 30 are made of a material such as sintered Ag and Ni, Cu, Sn, and Au plating, for example.

The coil conductor 20 is connected to the electrode 30 of the first flange portion 11 and the electrode 30 of the second flange portion 12. The coil conductor 20 has a first coil portion 21 disposed on the winding core portion 13 and a second coil portion 22 disposed on the projection portion 15. The first coil portion 21 and the second coil portion 22 are electrically connected between the two electrodes 30 and are connected to each other in series. The first coil portion 21 has a coil shape wound around the winding core portion 13. The second coil portion 22 has a coil shape wound around the projection portion 15.

Each of the first coil portion 21 and the second coil portion 22 acts as an inductor. The second coil portion 22 has an inductance value different from an inductance value of the first coil portion 21. The second coil portion 22 has the number of turns smaller than the number of turns of the first coil portion 21. The second coil portion 22 has a cross-sectional area of the coil shape smaller than a cross-sectional area of the coil shape of the first coil portion 21. Therefore, the inductance value of the second coil portion 22 is smaller than the inductance value of the first coil portion 21.

The first coil portion 21 and the electrode 30 of the second flange portion 12 are connected through a first connection line 25. The first coil portion 21 and the second coil portion 22 are connected through a second connection line 26. The second coil portion 22 and the electrode 30 of the first flange portion 11 are connected through a third connection line 27. The first, second, and third connection lines 25, 26, 27 are portions of the coil conductor 20.

The coil conductor 20 is made of a copper-nickel-plated wire material. The wire material may be not only the copper-nickel-plated wire material but also, for example, a wire material made of a conductive material such as Cu, Al, Au, and Ag, or a polyesterimide copper wire material. The coil conductor 20 may be, for example, a solid wire or a litz wire. The coil conductor 20 may be a magnetic-plated wire (made of a wire material containing nickel and iron and coated with plating). A film covering the wire material may be made of a material having a dielectric constant of 20 or less and having a heat-resisting property and a self-fusing property such as polyesterimide, polyesteramide, and polyurethane.

Figure 2:
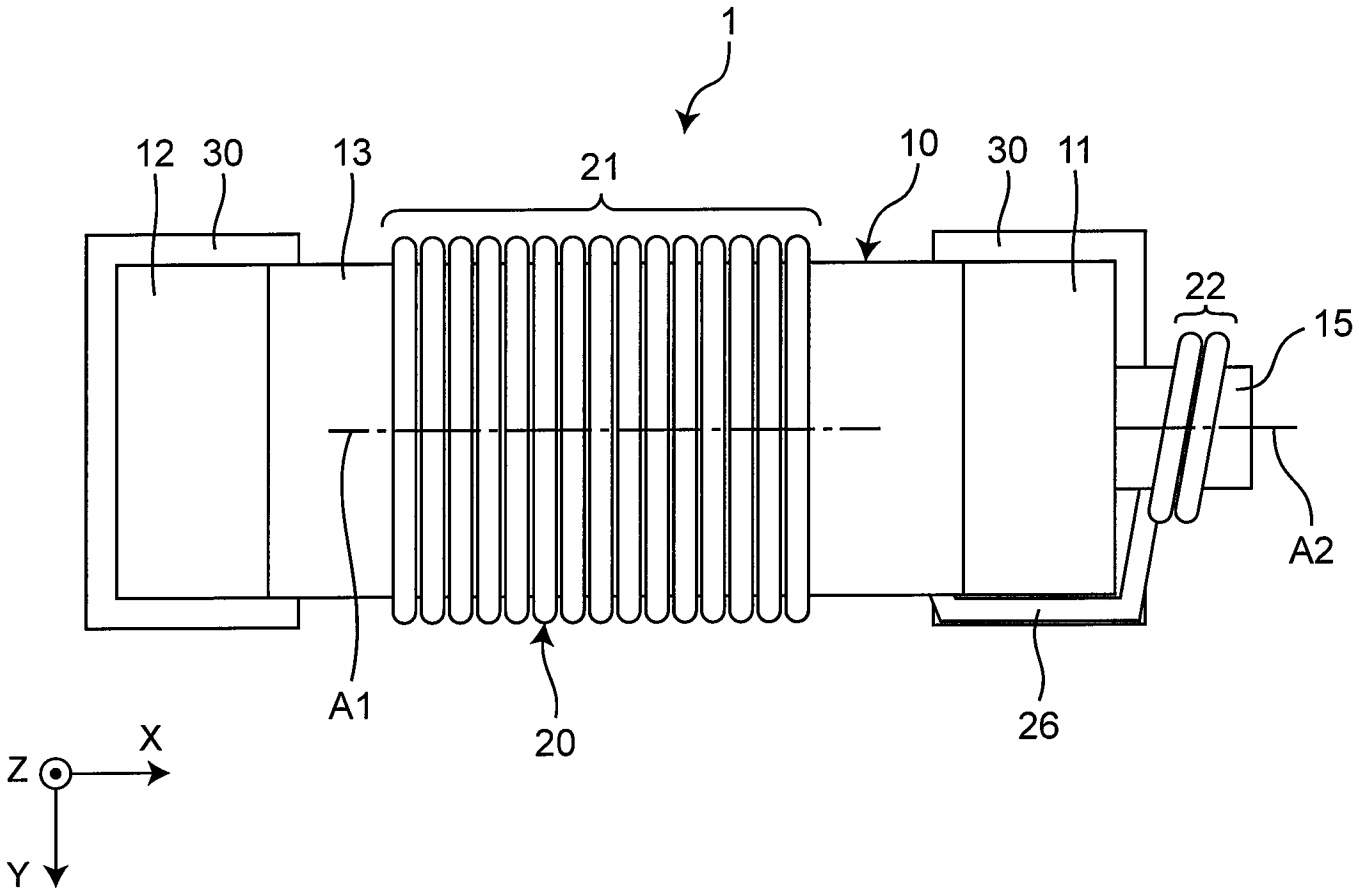
FIG. 2 is a plane view of the coil component.

FIG. 2 is a plane view of the coil component 1 viewed in the Z-direction. As shown in FIG. 2, an axis A2 of the second coil portion 22 is coaxial with an axis A1 of the first coil portion 21. The axis A1 of the first coil portion 21 and the axis A2 of the second coil portion 22 are the central axes of the respective coil shapes.

In other words, the axis A2 of the second coil portion 22 is coincident (concentric) on the extended line thereof with the axis A1 of the first coil portion 21. The axis A1 of the first coil portion 21 is coincident with the axis of the winding core portion 13. The axis A2 of the second coil portion 22 is coincident with the axis of the projection portion 15.

A method of mounting the coil component 1 will be described.

Figure 3:
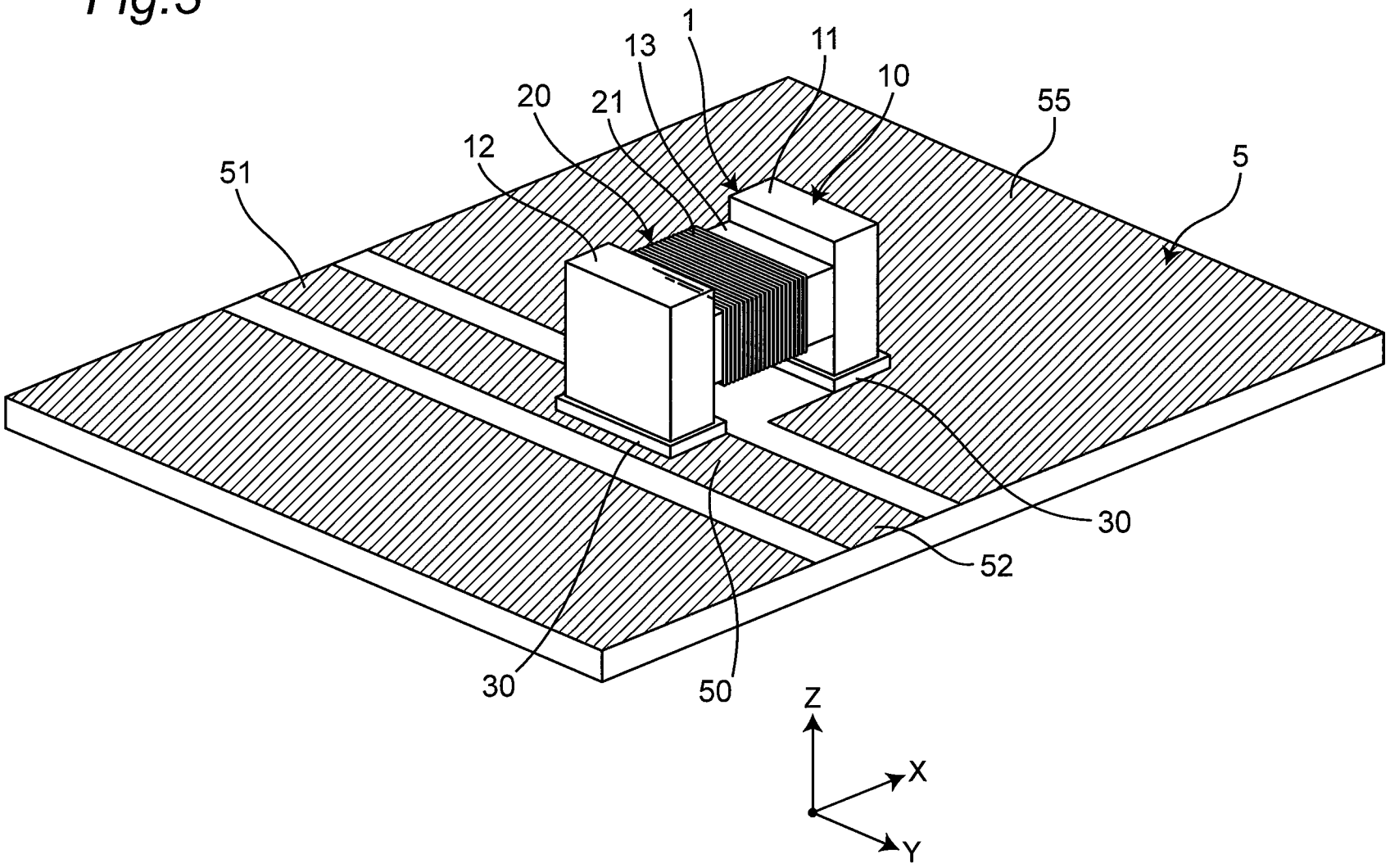
FIG. 3 is a perspective view of a mounted state of the coil component on a substrate.

As shown in FIG. 3, the coil component 1 is connected to and mounted on a signal line 50 of a substrate 5. The substrate 5 has the signal line 50 and a ground electrode portion 55 electrically insulated from the signal line 50. The signal line 50 has a first port 51 and a second port 52. In FIG. 3, a conductive part of the substrate 5 is indicated by hatching.

First, the coil component 1 is shunt-connected to the signal line 50. Specifically, the electrode 30 disposed on the first flange portion 11 of the core 10 is electrically connected to the ground electrode portion 55, and the electrode 30 disposed on the second flange portion 12 of the core 10 is electrically connected to the signal line 50. The second coil portion 22 is located on the side of the ground electrode portion 55. Therefore, the signal line 50 is electrically connected via the coil conductor 20 of the coil component 1 to the ground electrode portion 55.

A radio frequency (RF) signal is propagated through the signal line 50 from the first port 51 toward the second port 52. In this state, a direct current is applied from the ground electrode portion 55 to the signal line 50 via the coil component 1 to superimpose the direct current with the signal of the signal line 50.

In the state of the coil component 1 mounted on the substrate 5 as described above, for example, the propagation characteristics of the signal line 50 of the substrate 5 can be evaluated. The measurement of the propagation characteristics is, for example, the measurement of S21. The S21 indicates a transmission quantity of a signal when the signal incident on the first port 51 is transmitted to the second port 52.

According to the coil component 1, the first coil portion 21 is disposed on the winding core portion 13 while the second coil portion 22 is disposed on the projection portion 15, and the inductance value of the first coil portion 21 is different from the inductance value of the second coil portion 22. Therefore, since the second coil portion 22 is added to the first coil portion 21, when the coil component 1 is shunt-connected and mounted on the signal line 50 of the substrate 5, an impedance is made higher by generating a plurality of resonances in other than the resonance frequency range generated by the first coil portion acting 21 as a main coil, and a wider bandwidth can consequently be achieved in frequency characteristics so as to suppress a mode associated with a signal propagating in the shunt direction. Thus, the deterioration in the propagation characteristics of the signal line 50 can be suppressed to prevent the deterioration in signal quality.

Since the axis A2 of the second coil portion 22 is coaxial with the axis A1 of the first coil portion 21, the first coil portion 21 and the second coil portion 22 can concentrically be wound. This stabilizes the winding of the first and second coil portions 21, 22 and stabilizes the winding pitches of the first and second coil portions 21, 22, thereby suppressing variations in the frequency characteristics.

An example of the coil component 1 will be described.

The example has the same structure as the structure of the coil component 1 shown in FIG. 1. The size of the coil component 1 is 2.0 mm (L dimension)×0.8 mm (W dimension), including the projection portion 15. The coil conductor 20 is made of a nickel-plated wire material. The number of turns of the first coil portion 21 is 15. The number of turns of the second coil portion 22 is two. The first coil portion 21 having the number of turns changed within a range of 5 to 20 produces the same result as the following description.

Figure 4:
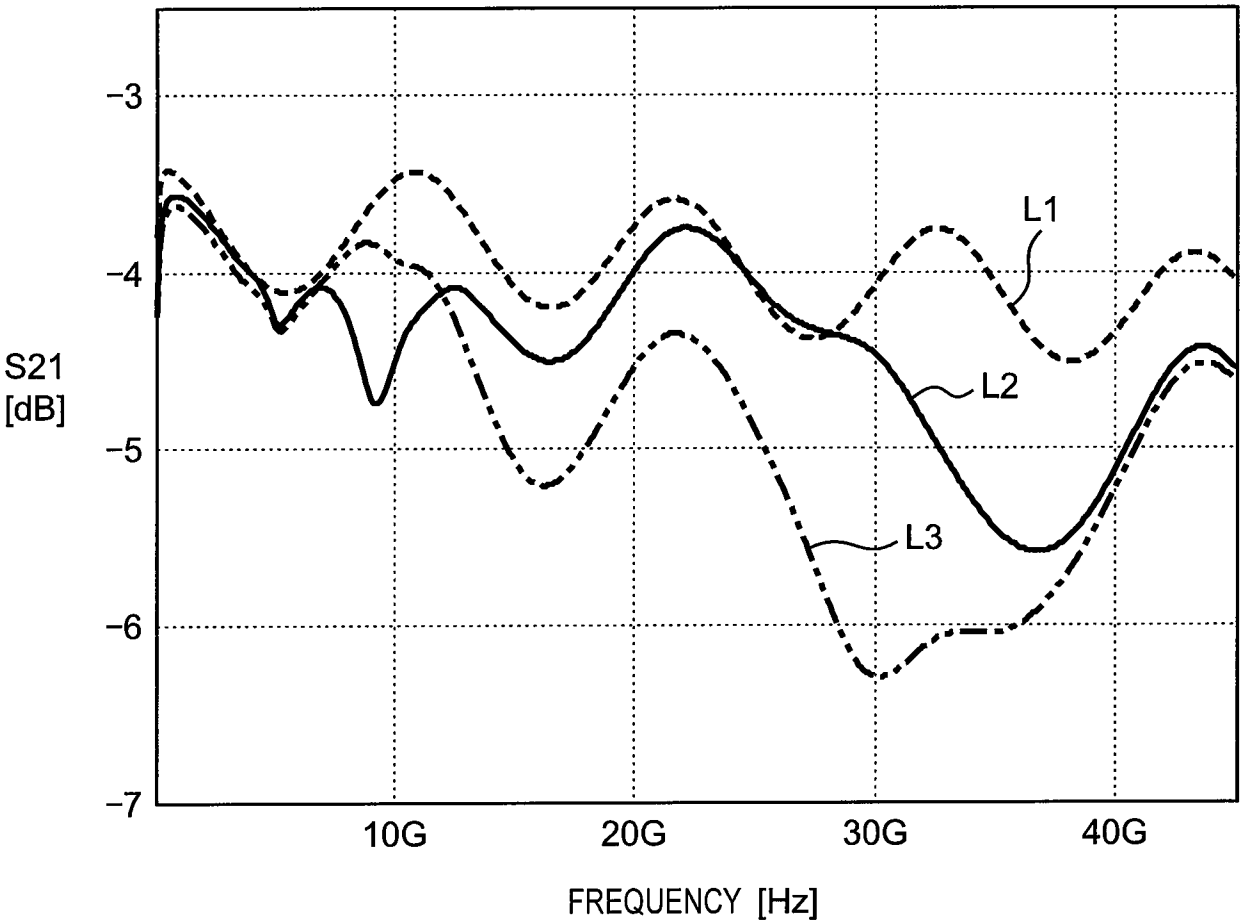
FIG. 4 is a graph of a measurement result of S21 of an example of the present disclosure.

While the coil component 1 is mounted on the signal line 50 of the substrate 5 as shown in FIG. 3, S21 of the signal line 50 is measured and the result is shown in FIG. 4. In FIG. 4, the horizontal axis indicates a frequency of a signal propagating through the signal line 50. The vertical axis indicates a value of S21, and a higher numerical value of S21 indicates better characteristics of S21.

In FIG. 4, a graph L1 shown by a dotted line indicates a theoretical value of the signal line 50 of the substrate 5 and indicates a calculation value of passage characteristics of the signal line 50 of the substrate 5 shown in FIG. 3. A graph L2 shown by a solid line represents the example and indicates a calculation value of passage characteristics of the signal line 50 when the coil component 1 shown in FIG. 3 is mounted on the substrate 5. A graph L3 shown by a dashed-two dotted line represents a comparison example without the structure or the second coil portion of the example. Therefore, the graph L3 indicates a calculation value of passage characteristics of the signal line 50 when a coil component disposed only with the first coil portion 21 of the coil component 1 shown in FIG. 3 is mounted on the substrate 5.

As shown in FIG. 4, the example (graph L2) produces a result close to the theoretical value (graph L1) and suppresses a deterioration in S21. In contrast, the comparison example (graph L3) has S21 deteriorated in low and high frequencies due to the occurrence of resonance. This result reveals that the second coil portion of the example significantly contributes to the suppression of deterioration in S21.

Second Embodiment

Figure 5:
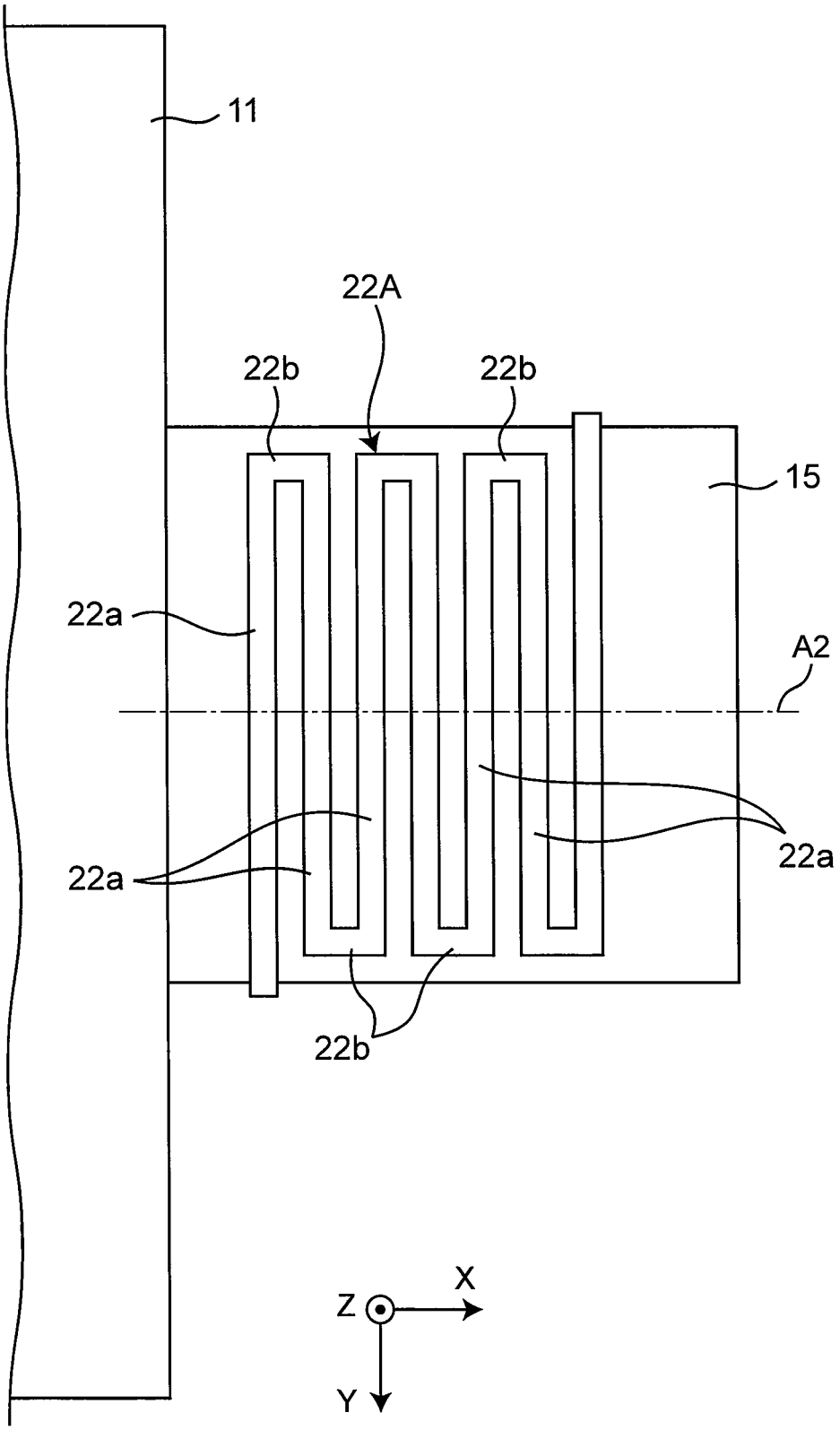
FIG. 5 is a plane view of a second coil portion of a coil component of a second embodiment of the present disclosure.

FIG. 5 is a plane view of a coil component of a second embodiment of the present disclosure. The second embodiment is different from the first embodiment in the shape of the second coil portion. This different configuration will hereinafter be described. In the second embodiment, the constituent elements denoted by the same reference numerals as the first embodiment are the same as those of the first embodiment and therefore will not be described.

As shown in FIG. 5, a second coil portion 22A has a meander shape. The meander shape is formed in a meandering manner such that linear portions 22*a* and folded portions 22*b* are alternately connected. The second coil portion 22A is disposed on one surface of the projection portion 15. The second coil portion 22A is formed by printing, for example. The material of the second coil portion 22A is, for example, a nickel-plated foil or a metal foil of Cu, Al, Au, Ag, etc.

The axis A2 of the second coil portion 22A is coincident with the X-direction. The axis A2 of the second coil portion 22A corresponds to the central line of the meander shape, i.e., a direction of extension of a line segment connecting the centers of the folded width of the meander shape and, specifically, the axis A2 of the second coil portion 22A passes through the centers of a plurality of the linear portions 22*a*. The axis A2 of the second coil portion 22A may be coaxial with the axis A1 of the first coil portion 21 (see FIG. 2) or may be a different axis.

According to the second embodiment, even when the second coil portion 22A is formed into the meander shape, the same effect is produced as is the case with the second coil portion formed into the coil shape described in the first embodiment. It is noted that the first coil portion may be formed into a meander shape.

Third Embodiment

Figure 6:
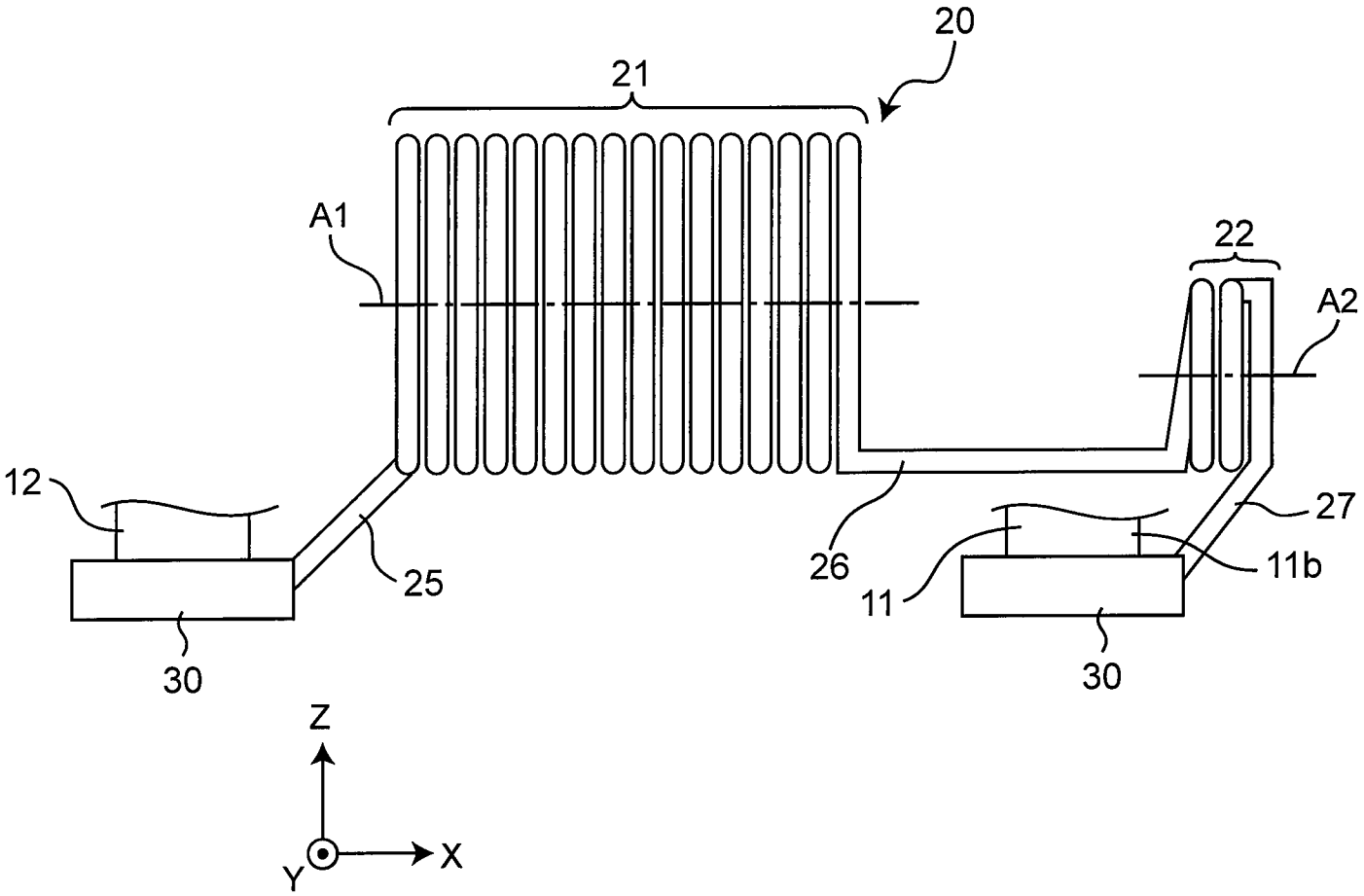
FIG. 6 is a simplified side view of a coil component of a third embodiment of the present disclosure.

FIG. 6 is a plane view of a coil component of a third embodiment of the present disclosure. The third embodiment is different from the first embodiment in the position of the second coil portion. This different configuration will hereinafter be described. In the third embodiment, the constituent elements denoted by the same reference numerals as the first embodiment are the same as those of the first embodiment and therefore will not be described.

As shown in FIG. 6, the axis A2 of the second coil portion 22 is not coaxial with the axis A1 of the first coil portion 21 and is a different axis. In other words, the axis A2 of the second coil portion 22 is not coincident (not concentric) on the extended line thereof with the axis A1 of the first coil portion 21. The axis A2 of the second coil portion 22 is parallel on the extended line thereof to the axis A1 of the first coil portion 21.

As a result, the second coil portion 22 can be made closer to a peripheral edge of the second end surface 11*b* of the first flange portion 11, and the second connection line 26 connecting the first coil portion 21 and the second coil portion 22 can be reduced in length. Therefore, the resonance due to reflection of a signal wave attributable to the length of the second connection line 26 can be suppressed.

The axis A2 of the second coil portion 22 is eccentric from the axis A1 of the first coil portion 21 toward the electrode 30 of the first flange portion 11. As a result, the second coil portion 22 can be made closer to the electrode 30, and the third connection line 27 connecting the second coil portion 22 and the electrode 30 can be reduced in length. Therefore, the resonance due to reflection of a signal wave attributable to the length of the third connection line 27 can be suppressed.

When the axis A2 of the second coil portion 22 is not coaxial with the axis A1 of the first coil portion 21 and is a different axis, the axis A2 of the second coil portion 22 may not intersect on the extended line thereof with the axis A1 of the first coil portion 21, or the axis A2 of the second coil portion 22 may intersect on the extended line thereof with the axis A1 of the first coil portion 21 at one point.

The axis A2 of the second coil portion 22 may be eccentric from the axis A1 of the first coil portion 21 in a direction different from the direction toward the electrode 30. As a result, the second coil portion 22 can be made closer to the peripheral edge of the second end surface 11*b* of the first flange portion 11, and the second connection line 26 can be reduced in length. Therefore, the resonance due to reflection of a signal wave attributable to the length of the second connection line 26 can be suppressed.

Fourth Embodiment

Figure 7:
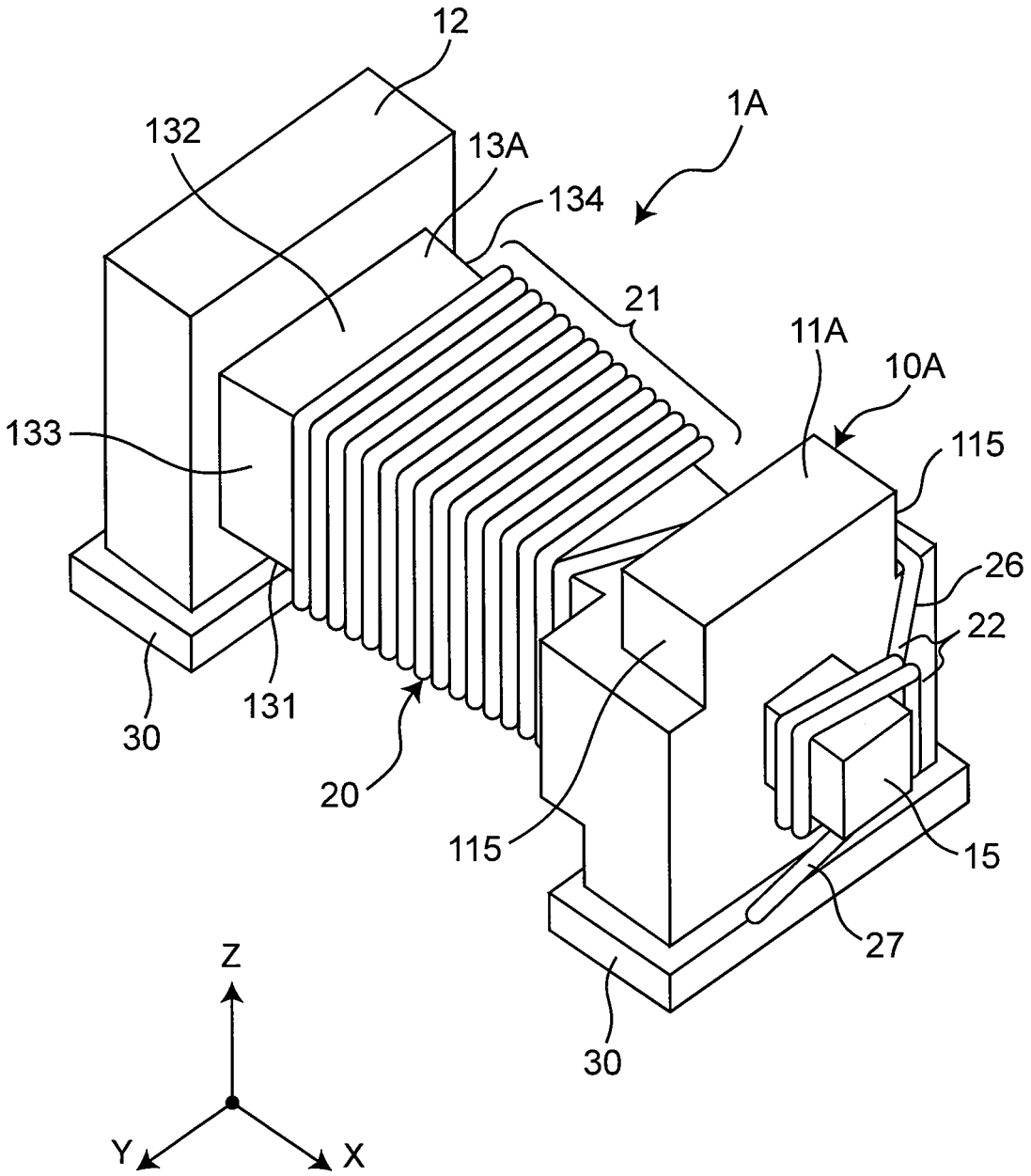
FIG. 7 is a perspective view of a coil component of a fourth embodiment of the present disclosure.

FIG. 7 is a perspective view of a coil component of a fourth embodiment of the present disclosure. The fourth embodiment is different from the first embodiment in the shape of the core. This different configuration will hereinafter be described. In the fourth embodiment, the constituent elements denoted by the same reference numerals as the first embodiment are the same as those of the first embodiment and therefore will not be described.

As shown in FIG. 7, a winding core portion 13A and a first flange portion 11A of a core 10A of a coil component 1A have different shapes as compared to the winding core portion 13 and the first flange portion 11 of the core 10 of the first embodiment.

The winding core portion 13A has four side surfaces 131 to 134 arranged in a circumferential direction around the axis of the winding core portion 13A. The first side surface 131 is a bottom surface facing a mounting surface. The second side surface 132 is a top surface opposite to the first side surface 131. The third side surface 133 and the fourth side surface 134 are left and right side surfaces opposite to each other in the Y-direction.

The first side surface 131 and the second side surface 132 are parallel to the axis of the winding core portion 13A. The third side surface 133 and the fourth side surface 134 are inclined relative to the axis of the winding core portion 13A. The third side surface 133 and the fourth side surface 134 are inclined from the second flange portion 12 toward the first flange portion 11A to come closer to the axis of the winding core portion 13A. Therefore, the cross-sectional area of the winding core portion 13A gradually decreases from the second flange portion 12 toward the first flange portion 11A.

The number of the side surfaces of the winding core portion may be three or five or more instead of four. At least one side surface of the plurality of the side surfaces of the winding core portion may be inclined relative to the axis of the winding core portion. At least one side surface may be inclined from the first flange portion 11A toward the second flange portion 12 to come closer to the axis of the winding core portion 13. The shape of the winding core portion may be a circular cone instead of a rectangular parallelepiped.

Therefore, since the third and fourth side surface 133, 134 of the winding core portion 13A are inclined relative to the axis of the winding core portion 13A, the area of the cross section orthogonal to the axis of the winding core portion 13A can be varied along the axis of the winding core portion 13A, and a wider bandwidth can be achieved in the frequency characteristics of the first coil portion 21 wound around the winding core portion 13A. As a result, the mode associated with a signal propagating in the shunt direction can be suppressed.

The first flange portion 11A has cutouts 115. The cutouts 115 are disposed at left and right upper corners of the first flange portion 11A. One of the cutouts 115 allows passage of the second connection line 26 connecting the first coil portion 21 and the second coil portion 22. Therefore, the wiring route of the second connection line 26 can be made shorter. As a result, the resonance due to reflection of a signal wave attributable to the length of the second connection line 26 can be suppressed.

The fourth embodiment may have either the configuration in which a side surface of the winding core portion is inclined or the configuration in which a cutout is disposed on the first flange portion.

Fifth Embodiment

Figure 8:
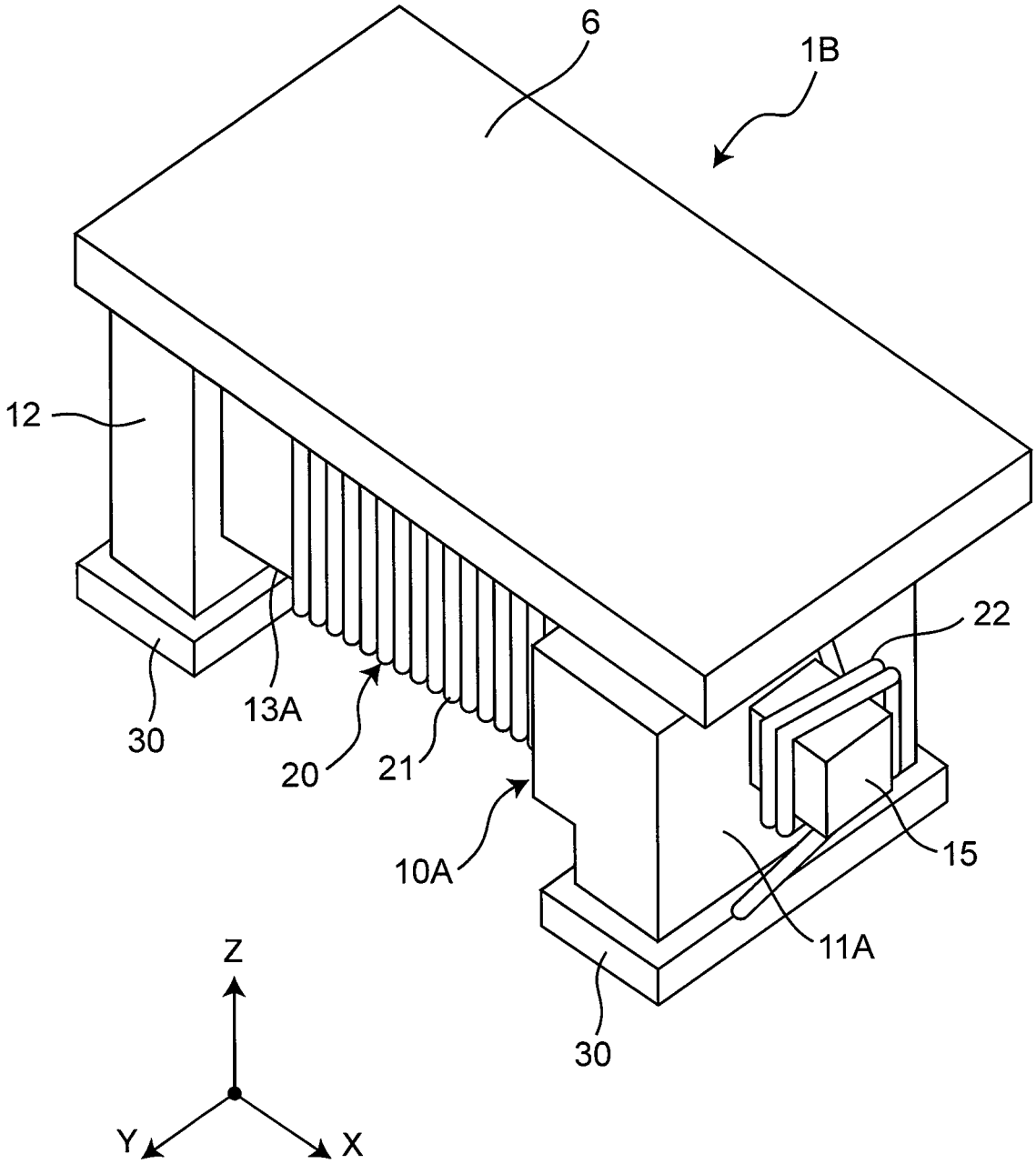
FIG. 8 is a perspective view of a coil component of a fifth embodiment of the present disclosure.

FIG. 8 is a perspective view of a coil component of a fifth embodiment of the present disclosure. The fifth embodiment is different from the fourth embodiment in that a top plate portion is included. This different configuration will hereinafter be described. In the fifth embodiment, the constituent elements denoted by the same reference numerals as the fourth embodiment are the same as those of the fourth embodiment and therefore will not be described.

As shown in FIG. 8, a coil component 1B has a top plate portion 6. The top plate portion 6 is a flat plate and is attached to the top surfaces of the first and second flange portions 11A, 12 to cover the top surface side of the first coil portion 21. Therefore, the top plate portion 6 is a protective member protecting the first coil portion 21. The top plate portion 6 is made of, for example, a dielectric material such as alumina or a resin such as LCP (liquid crystal polymer) and epoxy.

Sixth Embodiment

Figure 9:
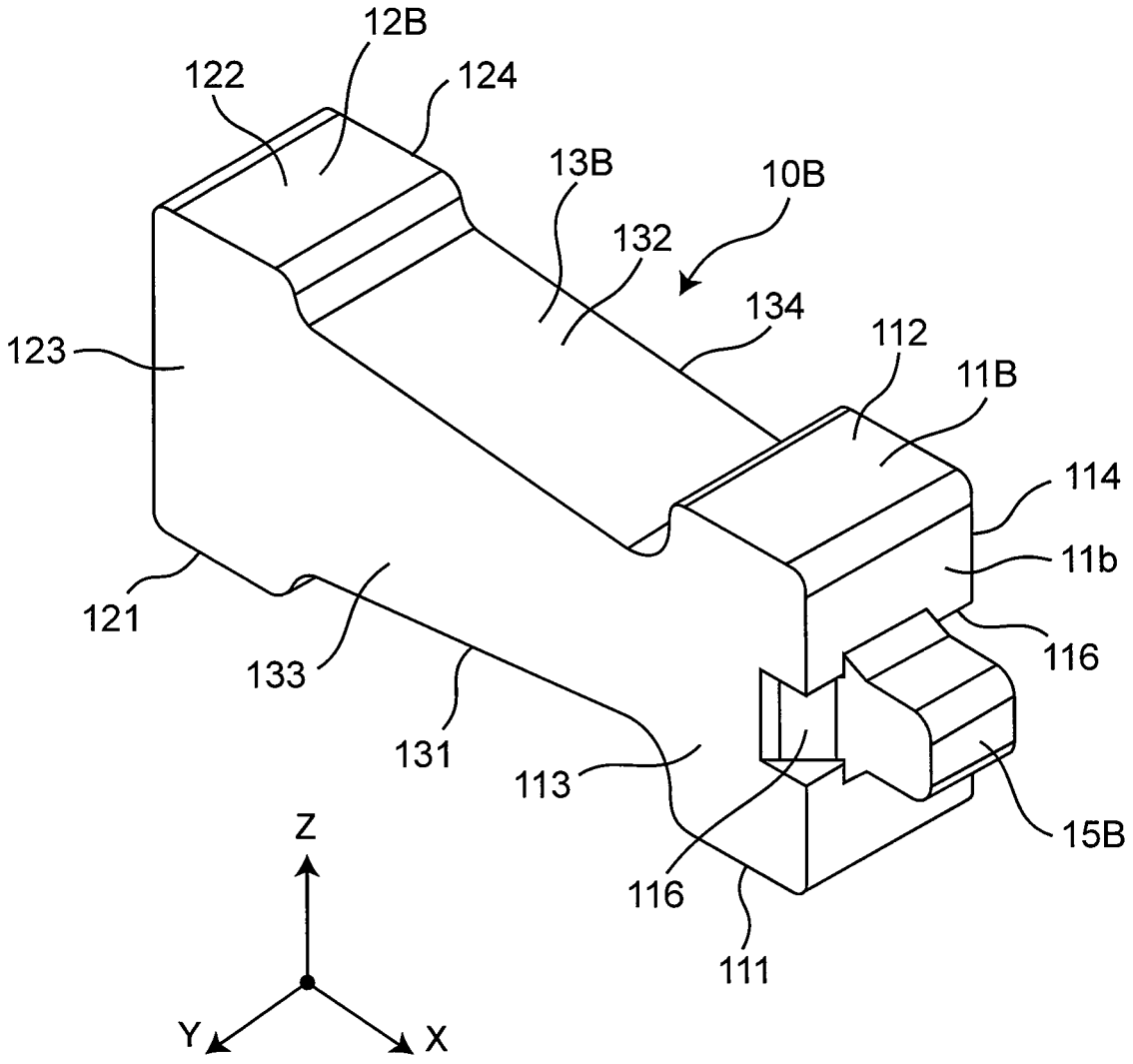
FIG. 9 is a perspective view of a core of a coil component of a sixth embodiment of the present disclosure.

FIG. 9 is a perspective view of a core of a coil component of a sixth embodiment of the present disclosure. The sixth embodiment is different from the first embodiment in the shape of the core. This different configuration will hereinafter be described. In the sixth embodiment, the constituent elements denoted by the same reference numerals as the first embodiment are the same as those of the first embodiment and therefore will not be described.

As shown in FIG. 9, a core 10B has a winding core portion 13B, a first flange portion 11B, a second flange portion 12B, and a projection portion 15B.

The winding core portion 13B has the four side surfaces 131 to 134 arranged in a circumferential direction around the axis of the winding core portion 13B. The first side surface 131 is a bottom surface facing a mounting surface. The second side surface 132 is a top surface opposite to the first side surface 131. The third side surface 133 and the fourth side surface 134 are left and right side surfaces opposite to each other in the Y-direction.

The third side surface 133 and the fourth side surface 134 are parallel to the axis of the winding core portion 13B. The first side surface 131 and the second side surface 132 are inclined relative to the axis of the winding core portion 13B. The first side surface 131 and the second side surface 132 are inclined from the second flange portion 12B toward the first flange portion 11B to come closer to the axis of the winding core portion 13B. Therefore, the cross-sectional area of the winding core portion 13B gradually decreases from the second flange portion 12B toward the first flange portion 11B.

Similarly, the first flange portion 11B has a first side surface 111 on the bottom surface side, a second side surface 112 on the top surface side, and third and fourth side surfaces 113, 114 on the left and right, and the second flange portion 12B has a first side surface 121 on the bottom surface side, and a second side surface 122 on the top surface side, and third and fourth side surfaces 123, 124 on the left and right.

The first side surface 111 of the first flange portion 11B and the first side surface 121 of the second flange portion 12B have a difference in level from the first side surface 131 of the winding core portion 13B. The second side surface 112 of the first flange portion 11B and the second side surface 122 of the second flange portion 12B has a difference in level from the second side surface 132 of the winding core portion 13B.

The third side surface 113 of the first flange portion 11B and the third side surface 123 of the second flange portion 12B are on the same plane as the third side surface 133 of the winding core portion 13B. The fourth side surface 114 of the first flange portion 11B and the fourth side surface 124 of the second flange portion 12B are on the same plane as the fourth side surface 134 of the winding core portion 13B.

The first flange portion 11B has cutouts 116. The cutouts 116 are disposed on both the left and right sides of the projection portion 15B in the Y-direction. One of the cutouts 116 is disposed from the third side surface 113 to the second end surface 11*b* until reaching a root of the projection portion 15B. The other cutout 116 is disposed from the fourth side surface 114 to the second end surface 11*b* until reaching a root of the projection portion 15B. Either one of the cutouts 116 allows passage of the second connection line 26 (see FIG. 1) connecting the first coil portion 21 and the second coil portion 22. Therefore, the wiring route of the second connection line 26 can be made shorter. As a result, the resonance due to reflection of a signal wave attributable to the length of the second connection line 26 can be suppressed.

The core 10B is formed by press working. The cutouts 116 are formed by a draft of a die. In particular, a draft taper for the draft of the die is used for the cutouts 116. All the third side surfaces 113, 123, 133 are on the same plane and all the fourth side surfaces 114, 124, 134 are on the same plane because inner surfaces of the die are flat surfaces.

Seventh Embodiment

Figure 10:
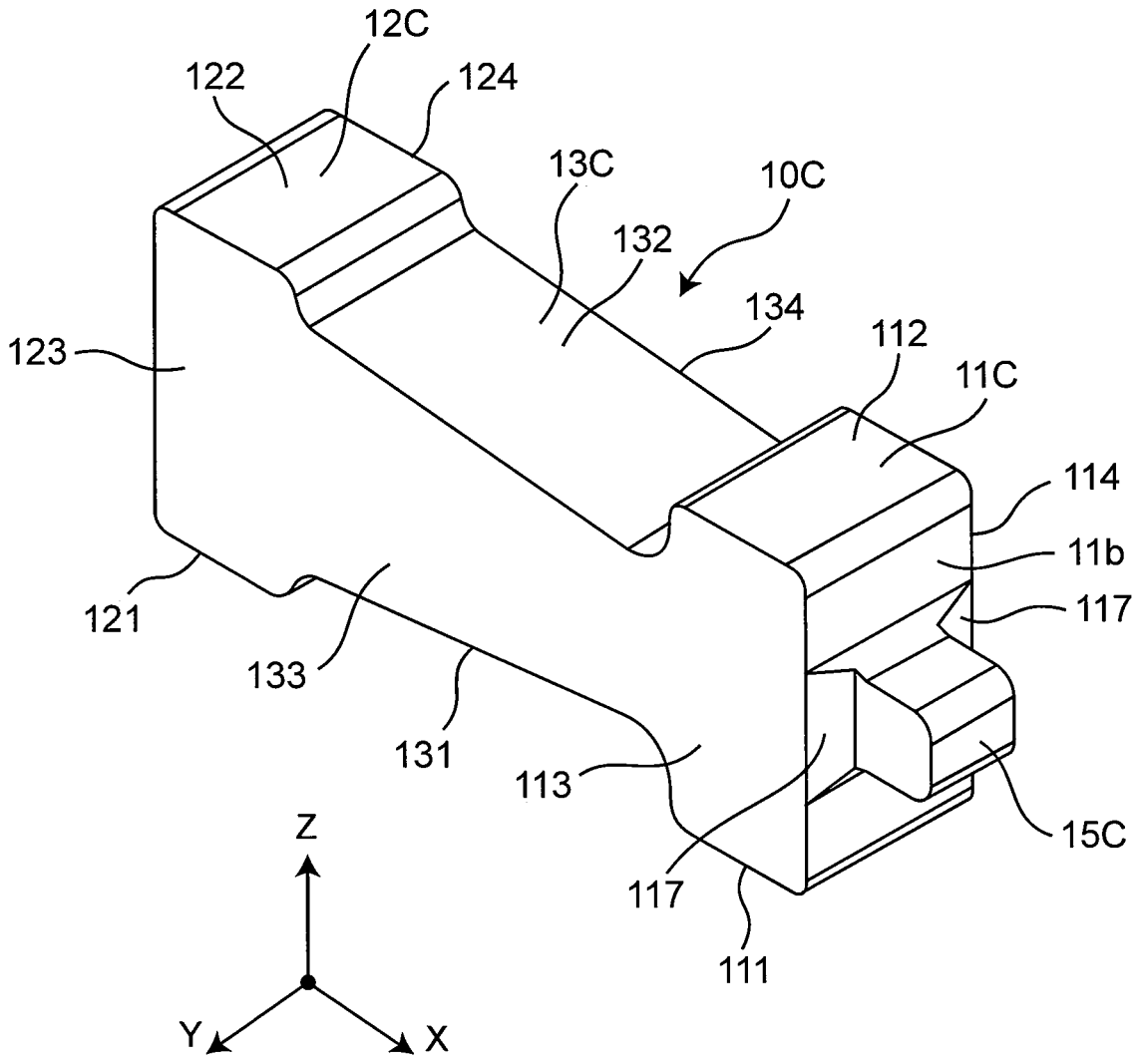
FIG. 10 is a perspective view of a core of a coil component of a seventh embodiment of the present disclosure.

FIG. 10 is a perspective view of a core of a coil component of a seventh embodiment of the present disclosure. The seventh embodiment is different from the sixth embodiment in the shape of the core. This different configuration will hereinafter be described. In the seventh embodiment, the constituent elements denoted by the same reference numerals as the sixth embodiment are the same as those of the sixth embodiment and therefore will not be described.

As shown in FIG. 10, a core 10C has a winding core portion 13C, a first flange portion 11C, a second flange portion 12C, and a projection portion 15C. The winding core portion 13C, the second flange portion 12C, and the projection portion 15C are configured in the same way as the winding core portion 13B, the second flange portion 12B, and the projection portion 15B of the sixth embodiment.

The second end surface 11*b* of the first flange portion 11C is disposed with inclined surfaces 117. The inclined surfaces 117 are disposed on both the left and right sides of the projection portion 15C in the Y-direction. The inclined surfaces 117 are disposed from the peripheral edges of the second end surface 11*b* until reaching a root of the projection portion 15C.

The core 10C is formed by press working. The inclined surfaces 117 are formed by a draft of a die. In particular, a draft taper for the draft of the die is used for the inclined surfaces 117.

Eighth Embodiment

Figure 11:
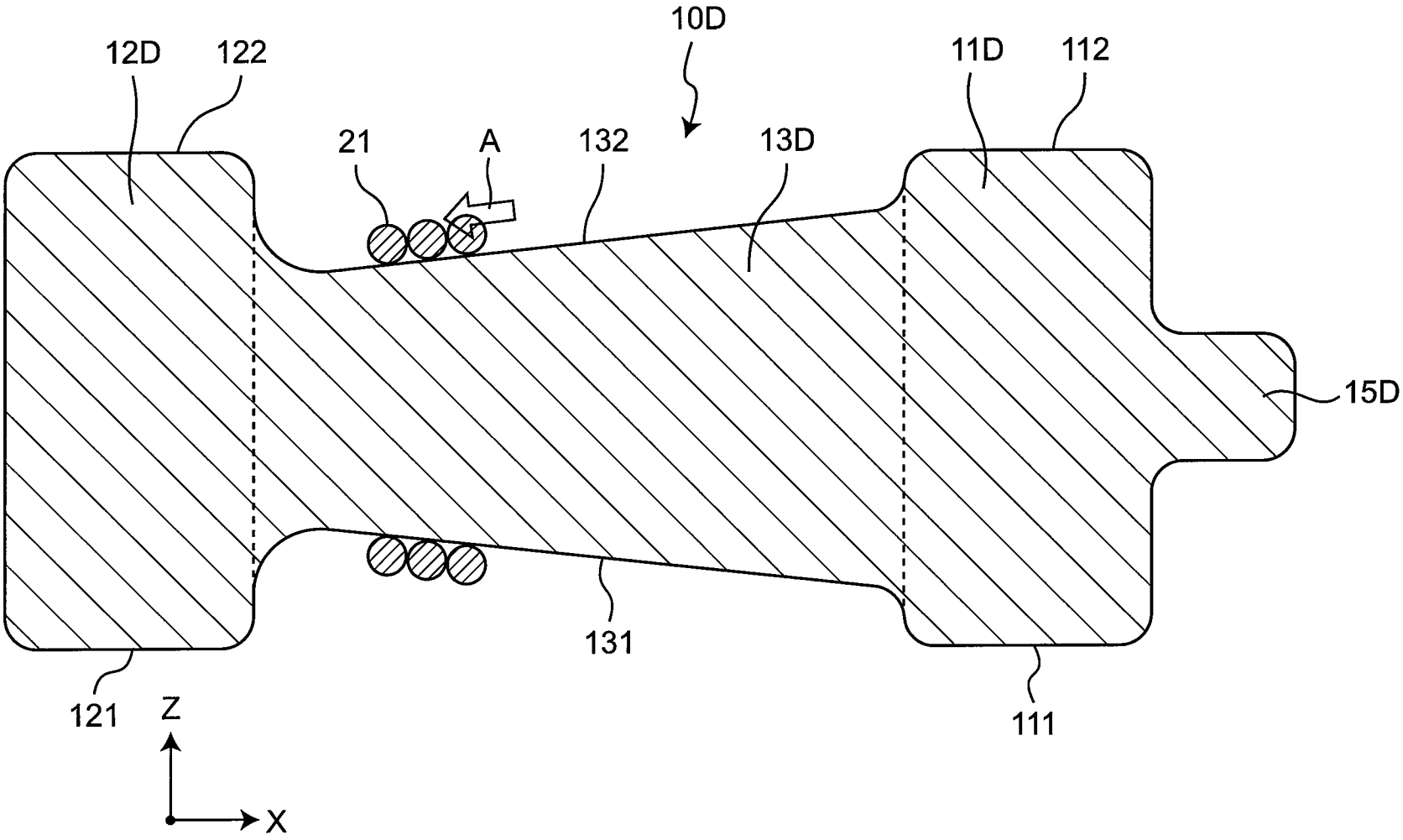
FIG. 11 is a cross-sectional view of a core of a coil component of an eighth embodiment of the present disclosure.

FIG. 11 is a cross-sectional view of a core of a coil component of an eighth embodiment of the present disclosure. The eighth embodiment is different from the sixth embodiment in the shape of the core. This different configuration will hereinafter be described.

As shown in FIG. 11, a core 10D has a winding core portion 13D, a first flange portion 11D, a second flange portion 12D, and a projection portion 15D. The first flange portion 11D, the second flange portion 12D, and the projection portion 15D are configured in the same way as the first flange portion 11B, the second flange portion 12B, and the projection portion 15B of the sixth embodiment.

The first side surface 131 and the second side surface 132 of the winding core portion 13D is inclined relative to the axis of the winding core portion 13D. The first side surface 131 and second side surface 132 are inclined from the first flange portion 11D toward the second flange portion 12D to come closer to the axis of the winding core portion 13D. Therefore, the cross-sectional area of the winding core portion 13D gradually decreases from the first flange portion 11D toward the second flange portion 12D.

Thus, when the first coil portion 21 is wound around the winding core portion 13D from the side of the second flange portion 12D, the first coil portion 21 is wound along the first side surface 131 and second side surface 132. Since the first side surface 131 and second side surface 132 are inclined, the first coil portion 21 receives a force toward the second flange portion 12 as indicated by a direction of an arrow A. Therefore, since the first coil portion 21 is lined up on the winding start side, the first coil portion 21 is tightly wound and the winding state of the first coil portion 21 is stabilized.

Ninth Embodiment

Figure 12:
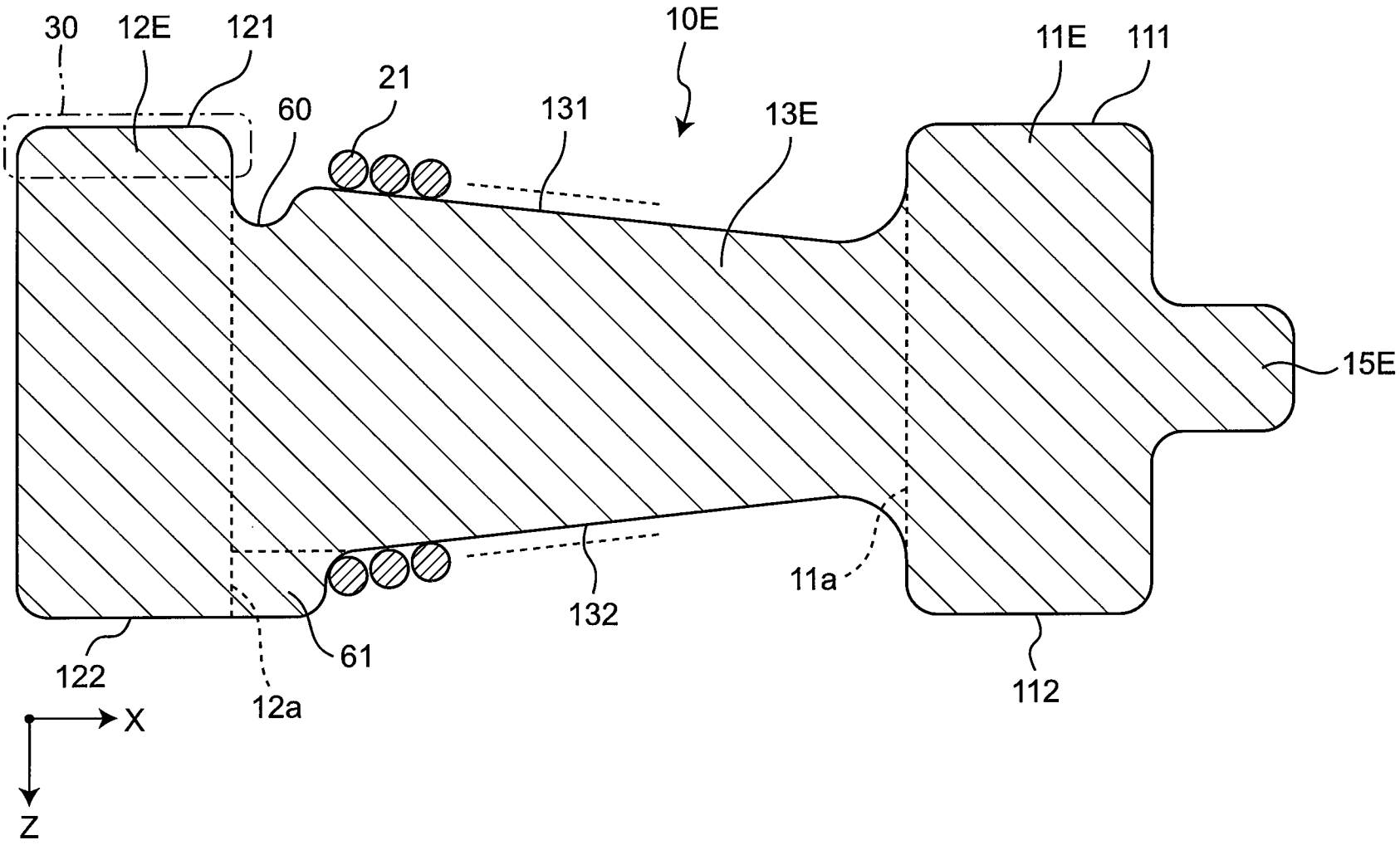
FIG. 12 is a cross-sectional view of a core of a coil component of a ninth embodiment of the present disclosure.

FIG. 12 is a cross-sectional view of a core of a coil component of a ninth embodiment of the present disclosure. The ninth embodiment is different from the sixth embodiment in the shape of the core. This different configuration will hereinafter be described.

As shown in FIG. 12, the core 10E has a winding core portion 13E, a first flange portion 11E, a second flange portion 12E, and a projection portion 15E. The first flange portion 11E and the projection portion 15E are configured in the same way as the first flange portion 11B and the projection portion 15B of the sixth embodiment.

The electrodes 30 are disposed on the first side surface 111 on the bottom surface side of the first flange portion 11E and the first side surface 121 on the bottom surface side of the second flange portion 12E. The first side surface 131 on the bottom surface side of the winding core portion 13E is inclined from the second flange portion 12E toward the first flange portion 11E to come closer to the axis of the winding core portion 13E. The second side surface 132 of the winding core portion 13E is inclined from the second flange portion 12E toward the first flange portion 11E to come closer to the axis of the winding core portion 13E.

A groove portion 60 is disposed on the first side surface 131 on the bottom surface side of the winding core portion 13E. The groove portion 60 is disposed close to the second flange portion 12 in the winding core portion 13E. In particular, the groove portion 60 is disposed in a connection part of the first side surface 131 to the second flange portion 12. The groove portion 60 is opened from the third side surface 133 to the fourth side surface 134 (see FIG. 9) of the winding core portion 13E.

The depth of the groove portion 60 is a depth not allowing the electrode 30 to contact the bottom of the groove portion 60. Therefore, a z-direction distance between the first side surface 121 of the second flange portion 12E and the bottom of the groove portion 60 is greater than a depth of immersion of the first side surface 121 in a liquid electrode material at the time of formation of the electrode 30.

The first side surface 131 of the winding core portion 13E may be made parallel to the axis of the winding core portion 13E and, in this case, the groove portion 60 may be disposed close to at least one of the first flange portion 11E and the second flange portion 12E on the first side surface 131 of the winding core portion 13E. The first side surface 131 of the winding core portion 13E may be inclined from the first flange portion 11E toward the second flange portion 12E to come closer to the axis of the winding core portion 13E and, in this case, the groove portion 60 may be disposed close the first flange portion 11E in the winding core portion 13E.

At the time of manufacturing of the coil component, for example, the first side surface 111 of the first flange portion 11E and the first side surface 121 of the second flange portion 12E are immersed in the liquid electrode material to form the electrodes 30. In this case, since the first side surface 131 of the winding core portion 13E has the groove portion 60 disposed close to at least one of the first flange portion 11E and the second flange portion 12E, the liquid electrode material does not contact the first side surface 131 of the winding core portion 13E because of the groove portion 60.

Therefore, the liquid electrode material can be restrained from moving upward and wetting the first side surface 131 of the winding core portion 13E, so as to prevent the formation of the electrode 30 on the first side surface 131 of the winding core portion 13E. Thus, electric connection can be prevented between the first coil portion 21 disposed on the winding core portion 13E and the electrodes 30. Additionally, since the height of the electrodes 30 can be made larger in the Z-direction, if the electrodes 30 and a mounting substrate are connected by solder, an area of contact of the solder with the electrodes 30 can be made larger to increase a fixing strength between the electrodes 30 and the mounting substrate.

The groove portion 60 is disposed, between the both ends of the winding core portion 13E, on one end side of the winding core portion 13E having a smaller distance in the height direction from the first side surface 111 of the first flange portion 11E and the first side surface 121 of the second flange portion 12E. Since the groove portion 60 can be disposed on apart of the winding core portion 13E with which the liquid electrode material easily comes into contact at the time of formation of the electrodes 30, the formation of the electrodes 30 on the first side surface 131 of the winding core portion 13E can further reliably be prevented.

Additionally, a protrusion 61 is disposed on the first end surface 12*a* of the second flange portion 12E on the side of the winding core portion 13E. The protrusion 61 extends from the third side surface 123 to the fourth side surface 124 (see FIG. 9) of the second flange portion 12E. The protrusion 61 is disposed on the side of the second side surface 122 opposite to the electrode 30 of the second flange portion 12E. The protrusion 61 is connected to the second side surface 132 of the winding core portion 13E. The protrusion 61 may be disposed for at least one of the first to fourth side surfaces 121 to 124 of the second flange portion 12E.

Therefore, when the first coil portion 21 is wound from the second flange portion 12E to the first flange portion 11E, the start position of winding of the first coil portion 21 around the winding core portion 13E can be positioned by the protrusion 61 to stabilize the shape of winding of the first coil portion 21 around the winding core portion 13E.

Although a portion of the first coil portion 21 is not located in the groove portion 60 in this embodiment, a portion of the first coil portion 21 may be located in the groove portion 60. Although the groove portion 60 and the protrusion 61 are disposed in this embodiment, either the groove portion 60 or the protrusion 61 may be disposed.

Tenth Embodiment

Figure 13:
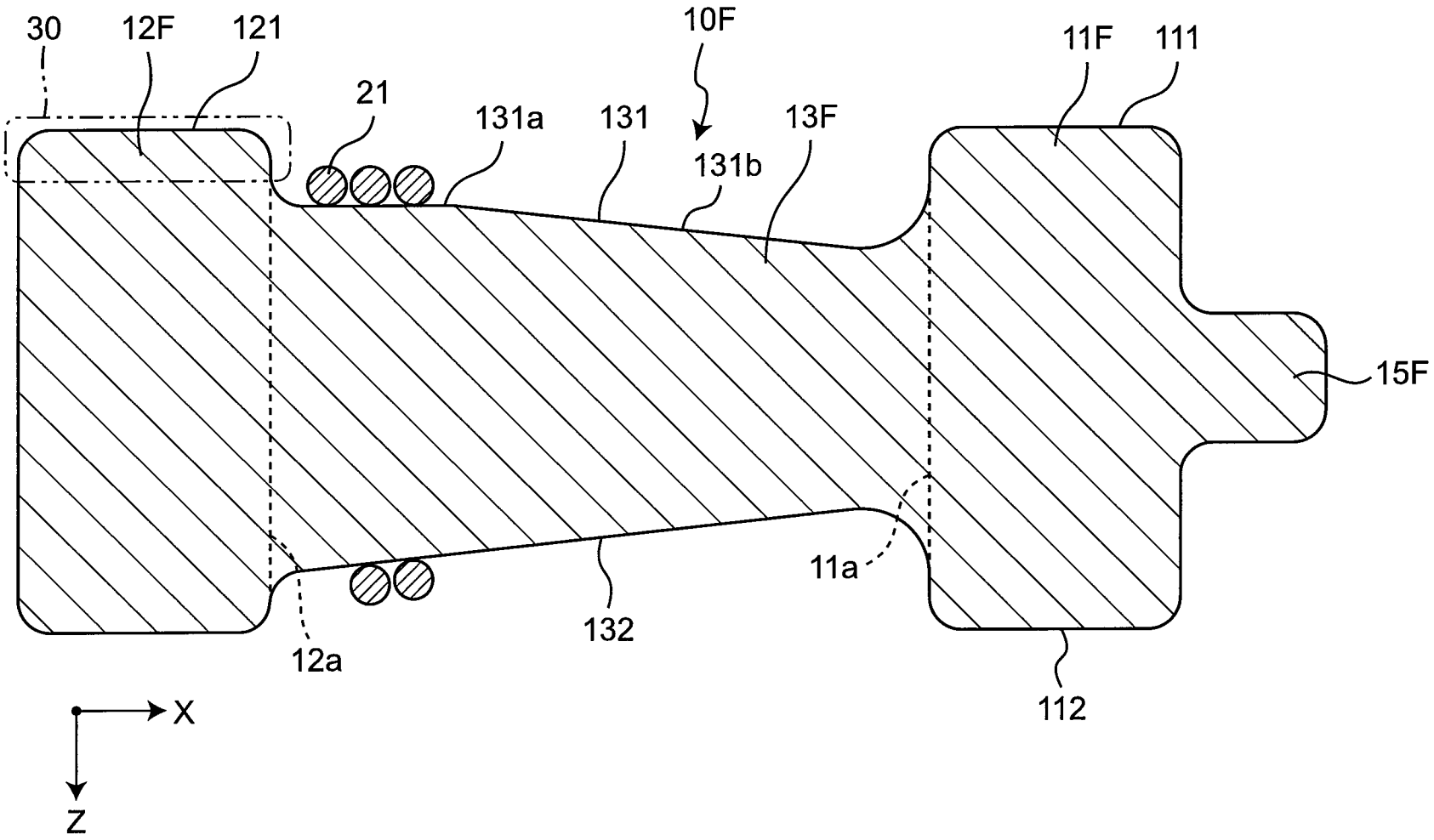
FIG. 13 is a cross-sectional view of a core of a coil component of a tenth embodiment of the present disclosure.

FIG. 13 is a cross-sectional view of a core of a coil component of a tenth embodiment of the present disclosure. The tenth embodiment is different from the sixth embodiment in the shape of the core. This different configuration will hereinafter be described.

As shown in FIG. 13, a core 10F has a winding core portion 13F, a first flange portion 11F, a second flange portion 12F, and a projection portion 15F. The first flange portion 11F and the projection portion 15F are configured in the same way as the first flange portion 11B and the projection portion 15B of the sixth embodiment.

The electrodes 30 are disposed on the first side surface 111 on the bottom surface side of the first flange portion 11F and the first side surface 121 on the bottom surface side of the second flange portion 12F. The first side surface 131 on the bottom surface side of the winding core portion 13F has a flat surface 131*a* and an inclined surface 131*b*. The flat surface 131*a* is located closer to the second flange portion 12F as compared to the inclined surface 131*b*. The flat surface 131*a* is parallel to the axis of the winding core portion 13F. The inclined surface 131*b* is inclined from the second flange portion 12F toward the first flange portion 11F to come closer to the axis of the winding core portion 13F.

The second side surface 132 of the winding core portion 13F does not have a flat surface. The second side surface 132 is inclined from the second flange portion 12F toward the first flange portion 11F to come closer to the axis of the winding core portion 13F. The second side surface 132 may have a flat surface. At least one of the first side surface 131 and the second side surface 132 may have a plurality of flat surfaces. At least one of the first side surface 131 and the second side surface 132 may have only the flat surface.

A z-direction distance between the first side surface 121 of the second flange portion 12F and the flat surface 131*a* of the first side surface 131 of the winding core portion 13F is a length not allowing the electrode 30 to contact the flat surface 131*a*. Therefore, this distance is greater than the depth of immersion of the first side surface 121 in the liquid electrode material at the time of formation of the electrode 30. For example, this distance is 0.1 mm.

At the time of manufacturing of the coil component, for example, the first side surface 111 of the first flange portion 11F and the first side surface 121 of the second flange portion 12F are immersed in the liquid electrode material to form the electrodes 30. In this case, since the first side surface 131 of the winding core portion 13F has the flat surface 131*a* closer to the second flange portion 12F, the liquid electrode material does not contact the flat surface 131*a*.

Therefore, the liquid electrode material can be restrained from moving upward and wetting the first side surface 131 of the winding core portion 13F, so as to prevent the formation of the electrode 30 on the first side surface 131 of the winding core portion 13F. Thus, electric connection can be prevented between the first coil portion 21 disposed on the winding core portion 13F and the electrodes 30. Additionally, since the height of the electrodes 30 can be made larger in the Z-direction, if the electrodes 30 and the mounting substrate are connected by solder, an area of contact of the solder with the electrodes 30 can be made larger to increase a fixing strength between the electrodes 30 and the mounting substrate.

The present disclosure is not limited to the embodiments described above and can be changed in design without departing from the spirit of the present disclosure. For example, the respective characteristic points of the first to tenth embodiments may variously be combined.

Although the projection portion is disposed only on the first flange portion in the embodiments, the projection portions may be disposed on the first flange portion and the second flange portion. In this case, a third coil portion may be disposed on the projection portion of the second flange portion such that the third coil portion, the first coil portion, and the second coil portion are sequentially connected in series. The shape of the third coil portion may be a coil shape or a meander shape, for example.

Although the projection portion is formed by press-forming in the embodiments, the projection portion may be formed by cutting with a dicer or by injection molding.

Although the first coil portion and the second coil portion are wound around the core in the embodiments, the portions may be embedded inside the core by injection molding.

The invention claimed is:

1. A coil component comprising:

a winding core portion;

a first flange portion and a second flange portion disposed on opposite ends of the winding core portion;

electrodes disposed on the first flange portion and the second flange portion, respectively;

a first coil portion and a second coil portion connected electrically in series between the electrode of the first flange portion and the electrode of the second flange portion and connected to each other in series; and a projection portion disposed on an end surface of the first flange portion on the side opposite to the winding core portion, wherein the first coil portion is disposed on the winding core portion, the second coil portion is disposed on the projection portion, and the first coil portion has an inductance value different from an inductance value of the second coil portion.

2. The coil component according to claim 1, wherein the second coil portion has an axis coaxial with an axis of the first coil portion.

3. The coil component according to claim 1, wherein the second coil portion has an axis different from an axis of the first coil portion.

4. The coil component according to claim 3, wherein the axis of the second coil portion is eccentric from the axis of the first coil portion toward the electrode of the first flange portion.

5. The coil component according to claim 1, wherein the winding core portion has a plurality of surfaces arranged in a circumferential direction around an axis extending in both end directions of the winding core portion, and at least one surface of the plurality of surfaces is inclined relative to the axis of the winding core portion.

6. The coil component according to claim 1, wherein the first flange portion has a cutout allowing passage of a connection line connecting the first coil portion and the second coil portion.

7. The coil component according to claim 1, wherein the electrodes are disposed on a bottom surface of the first flange portion and a bottom surface of the second flange portion, and the winding core portion has a bottom surface disposed with a groove portion close to at least one of the first flange portion and the second flange portion.

8. The coil component according to claim 7, wherein the bottom surface of the winding core portion is inclined from one end to the other end of the winding core portion to come closer to the axis extending in the both end directions of the winding core portion, and the groove portion is disposed on the one end side of the winding core portion.

9. The coil component according to claim 1, wherein a protrusion is disposed on an end surface of the second flange portion on the side of the winding core portion.

* * * * *